US008118655B1

(12) United States Patent
Maksymec

(10) Patent No.: US 8,118,655 B1
(45) Date of Patent: Feb. 21, 2012

(54) CASINO GAME AND METHOD OF PLAY

(75) Inventor: Peter A. Maksymec, Las Vegas, NV (US)

(73) Assignee: Casino Advisory Services, LLC, Las Vegas, NV (US)

( * ) Notice: Subject to any disclaimer, the term of this patent is extended or adjusted under 35 U.S.C. 154(b) by 911 days.

(21) Appl. No.: 10/843,925

(22) Filed: May 12, 2004

(51) Int. Cl.
*A63F 1/00* (2006.01)

(52) U.S. Cl. ..... 463/13; 273/292

(58) Field of Classification Search ..... 463/13; 273/292

See application file for complete search history.

(56) References Cited

U.S. PATENT DOCUMENTS 5,823,873 A * 10/1998 Moody ..... 463/13
6,206,780 B1 * 3/2001 Awada ..... 463/13
2003/0162577 A1 * 8/2003 Hamud ..... 463/13
2003/0164590 A1 * 9/2003 Moody ..... 273/292
2003/0193141 A1 * 10/2003 Loewenstein et al. ..... 273/292
2003/0199294 A1 * 10/2003 Walker et al. ..... 463/13

* cited by examiner

*Primary Examiner* — Dmitry Suhol
*Assistant Examiner* — Andrew Kim
(74) *Attorney, Agent, or Firm* — Greenberg Traurig

(57) ABSTRACT

A video poker game incorporating a bonus award predicated on the strengths of a poker hand formed by initially dealt cards and replacement cards in combination. Other optional bonus awards are based on consecutive cards forming a winning poker hand and/or the winning cards being in sequence. The game is facilitated by a bonus hand displayed below or above a primary hand on a gaming device display. As five initial cards are dealt in a primary hand location they are simultaneously dealt in one or more bonus hand locations. Then, when replacement cards are dealt into the primary hand in the place of any discards, they are also dealt into the one or more bonus hand locations adjacent to the initial cards. The cards in the bonus hand are then evaluated to determine whether a bonus award has been won. It is also disclosed in another version that regardless of the number of replacement cards, the bonus hand is always formed of ten cards.

24 Claims, 6 Drawing Sheets

190

195 195

| | 1 | 2 | 3 | 4 | 5 |
|---|---|---|---|---|---|
| ROYAL FLUSH | 800 | 1600 | 2400 | 3200 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIRS | 2 | 4 | 6 | 8 | 10 |
| JACKS OR BETTER | 1 | 2 | 3 | 4 | 5 |

FIG. 2

CASINO GAME AND METHOD OF PLAY

FIELD OF THE INVENTION

The embodiments of the present invention relate to casino wagering game. More particularly, the embodiments relate to a video poker game and method of play.

BACKGROUND

The expansion of the gaming industry has created a great demand for new games of chance. Accordingly, as more and more casinos continue to be built competition for retaining current patrons and attracting new patrons increases. One method to retain and attract patrons is to provide patrons with the best new games available. Unfortunately, while new games of chance are being developed at a furious pace, many never hit the casino floor or, if they do, they are unpopular because of the complicated rules, the large casino edge and the general lack of player appeal.

The risk of developing an unpopular game is minimized by developing games based on currently popular games. For example, by providing a side wager for an underlying game of Blackjack the casino is not dedicating an entire table to an entirely new game of chance. Thus, even if the side wager is not popular, the casino can rely on the underlying game of Blackjack to generate revenue. Another popular casino game is video poker. Several simple variations of conventional video poker have become very successful over the years. Indeed, electronic gaming devices now account for more casino revenue than live games.

Therefore, there continues to be a need for new and easy to play casino games based on known popular games of chance.

SUMMARY

Accordingly, a first embodiment of the present invention comprises providing a player an option to place a side or bonus wager on a hand of video poker wherein all initial cards and replacement cards are considered in resolving the bonus wager. In general, conventional video poker is facilitated by an electronic gaming device incorporating a processor, random number generator, display screen and one or more player interfaces. After a player wager, the game begins with the player receiving on the display screen five initial cards from a simulated deck of cards. The player then holds or discards each of the five cards. Discards are replaced with new cards from the simulated deck of cards. The player wager is then resolved based on the strength of the five-card poker hand subsequent to the draw sequence. With the first embodiment of the present invention, the display screen incorporates a bonus hand window dedicated to displaying each card generated and displayed during the play of the game. In this manner, each displayed card is displayed throughout the play of the conventional video poker hand to form possible winning bonus poker hands based on the five initially dealt cards in combination with the replacement cards.

For example, assume the player is initially dealt the 6♥, 7♦, 5♠,, A♦ and A♠.. An experienced video poker player holds the pair of Aces and discards the remaining cards. Then, with respect to the underlying video poker game, three replacement cards are dealt to replace the discards. Assuming the three replacement cards are the A♥, A♣ and 2♥, the player's final five-card poker hand comprises four Aces. Therefore the player is entitled to a payout according to a corresponding pay table. In this example, the bonus hand window displays, in order, the 6♥, 7♦, 5♠,, A♦, A♠,, A♥, A♣ and 2♥. That is, the bonus hand window displays each dealt card in the order it was dealt. A first optional bonus award is predicated on the strongest five-card poker hand formed using the eight total cards. A second optional bonus award is predicated on a winning poker hand being comprised of five consecutive cards. A third optional bonus award is predicated on a poker hand being comprised of five consecutive cards wherein the poker hand is in sequence. Each optional bonus award is discussed in more detail below.

The three optional bonus awards are related to evaluating all cards dealt during the play of the underlying hand of video poker. Therefore, the bonus hand comprises between five cards (i.e., no replacement cards) and ten cards (i.e., five replacement cards). The first optional bonus award is related to the best five-card poker hand formed using all the cards of the bonus hand. The second optional bonus award is related to evaluating any five consecutively displayed cards in the bonus hand window. For example, five consecutive cards, within the series of cards displayed in the bonus hand window, comprising the A♥, 10♥, Q♥, K♥ and J♥ results in a Royal Flush. The third optional bonus award is similar to the second optional bonus award but requires the winning cards to be consecutive and in sequence (e.g., 10♥, J♥, Q♥, K♥ and A♥) wherein sequence may be from low to high or high to low.

Other embodiments, modifications and variations are evident from the corresponding drawings, detailed description and claims as set forth herein.

BRIEF DESCRIPTION OF THE DRAWINGS

FIG. 2 shows a conventional video poker pay table;

DETAILED DESCRIPTION

The operation of electronic gaming device or machines, including video poker and keno machines, is well known in the industry so that the minute details are not set forth herein. In general terms, video poker and keno machines are controlled by processors including, or in communication with, a random number generator. The random number generator generates the machine's outcomes. A display in communication with the processor provides visual information to players.

Figure 1:
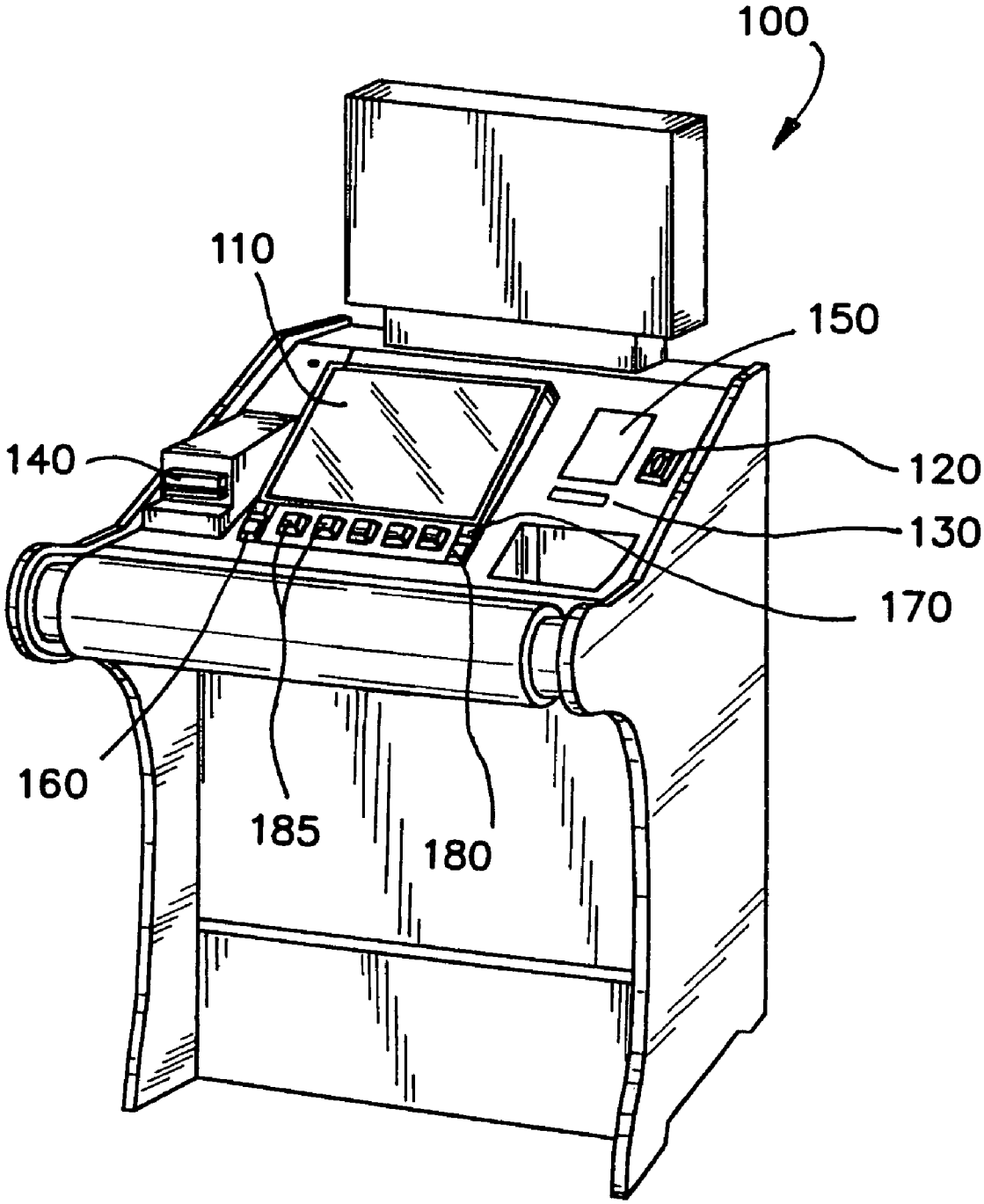
FIG. 1 shows an electronic gaming of the type used to facilitate a video embodiment of the present invention.

Reference is now made to the figures wherein like parts are referred to by like numerals throughout. FIG. 1 illustrates a perspective view of a video poker type gaming machine for facilitating the embodiments of the present invention and is generally denoted by reference numeral 100. The general external features of the video poker machine 100 include a display screen 110, coin slot 120, a card reader 130, a bill reader and validator 140 and a credit display 150. The gaming machine 100 also includes several player buttons which act as interfaces between the player and the machine processor. Player buttons include a one coin wager button 160, a maximum coin wager button 170, one or more bonus wager buttons 180 and hold/discard buttons 185. While not shown, the machine 100 may also incorporate a ticket dispenser for printing tickets for redemption at a cashier window or insertion into a gaming machine having a ticket reader. Such cashless systems are becoming increasingly popular in most gaming jurisdictions. It is noted that any of the functions facilitated by the gaming machine buttons 160-185 can be accomplished using a display employing touchscreen technology.

FIG. 2 shows a pay table 190 associated with conventional video poker. The pay table shows the payout corresponding to the poker hand and the number of units wagered 195. It is noted that other pay tables exist for conventional video poker and its many variations. Pay tables for the embodiments of the present invention (not shown) are dependent upon each of the cards displayed during the play of a hand. The size of wagers and associated payouts are formulated at the discretion of the machine manufacturers or the casino offering the embodiments of the present invention. The bonus wager amount is ideally less than the player's primary wager but may equal or be greater as well. The player is able to place bonus wagers via player buttons 180 or a touchscreen display. When a bonus wager is not placed, the machine is played in its conventional video poker fashion.

Figure 3:
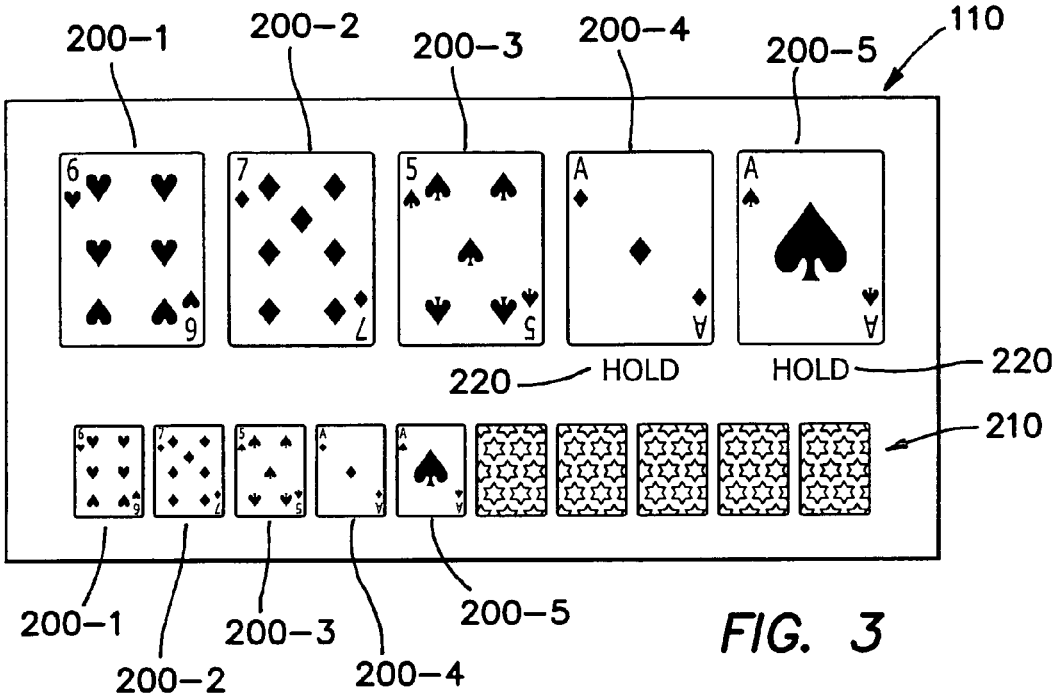
FIG. 3 shows a first example hand on a display screen incorporating a bonus hand window.

Now referring to FIG. 3, the display screen 110 displays an initial primary five-card poker hand, for illustrating a first optional bonus scheme, comprising the 6♥ 200-1, 7♦ 200-2, 5♠ 200-3, A♦ 200-4 and A♠ 200-5. A bonus hand window 210 is positioned below the primary poker hand. Alternatively, the bonus hand window 210 may be placed above the primary poker hand. The bonus hand window 210 mirrors the primary poker hand subsequent to the display of the initial five cards 200-1 through 200-5. As set forth above, in response to receiving the pair of Aces 200-4 and 200-5 with three junk cards, an experienced player holds the pair of Aces 220-4 and 200-5.

Figure 4:
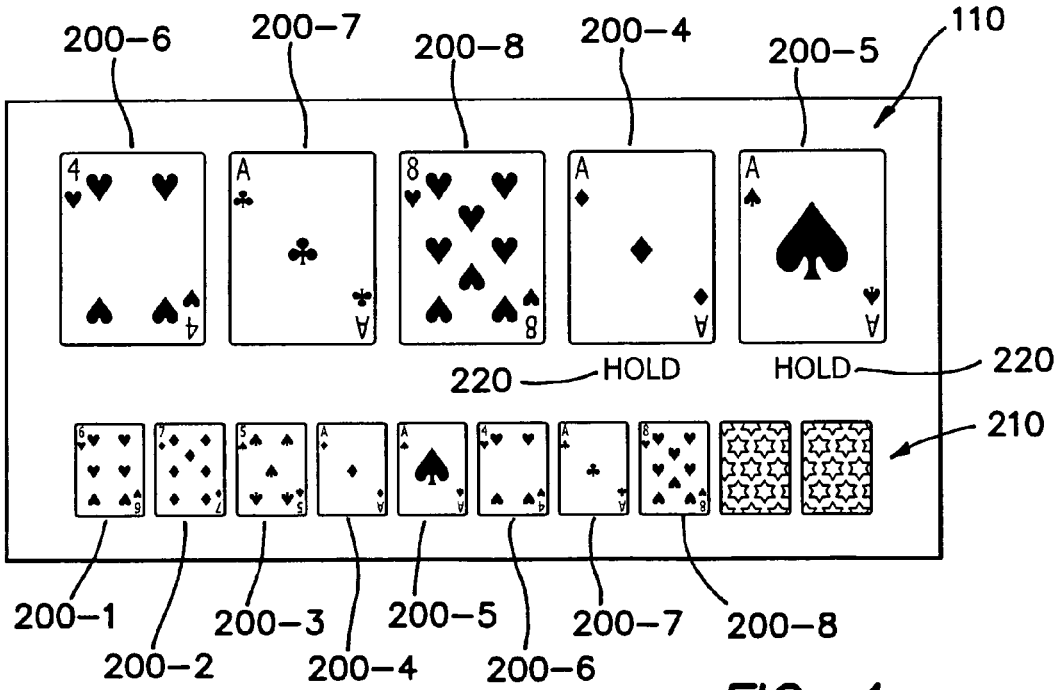
FIG. 4 shows the first example hand once replacement cards have been dealt.

Once the player makes the election to hold the pair of Aces 200-4 and 200-5 as noted by the HOLD icon 220, the three non-hold cards 200-1 through 200-3 are discarded and replaced in the primary hand, as shown in FIG. 4, with three random replacement cards comprising the 4♥ 220-6, A♣ 200-7 and 8♥ 200-8. Simultaneously with the display of the replacement cards 200-6 through 200-8 in the primary poker hand, the same replacement cards are displayed in the bonus hand window 210 in combination with the initial five cards 200-1 through 200-5. Accordingly, all eight cards 200-1 through 200-8 are displayed in succession in the bonus hand window 210. A first optional bonus award is based on the strongest five-card poker hand formed using all eight cards. In this case, the bonus hand is a straight formed by the 4♥ 220-6, 5♠ 200-3, 6♥ 200-1, 7♦ 200-2 and 8♥ 200-8. Therefore, the player may receive a bonus award for the bonus hand straight and receives an award, pursuant to pay table 190, for the three Aces 200-4, 200-5 and 200-7 in the primary hand.

Figure 5:
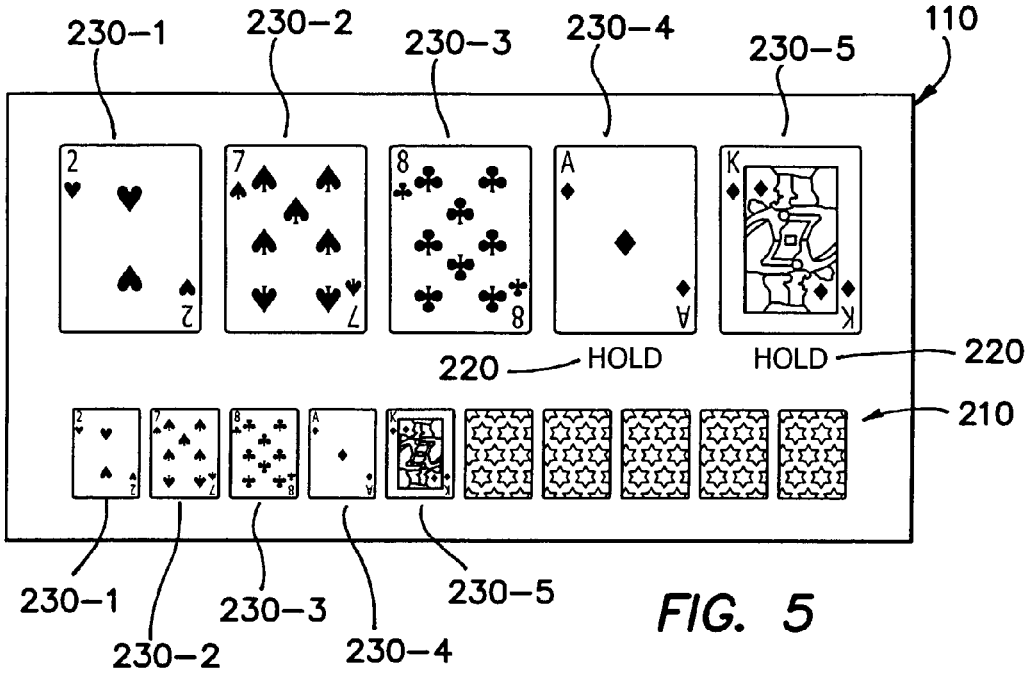
FIG. 5 shows a second example hand on a the display screen incorporating the bonus hand window.
Figure 6:
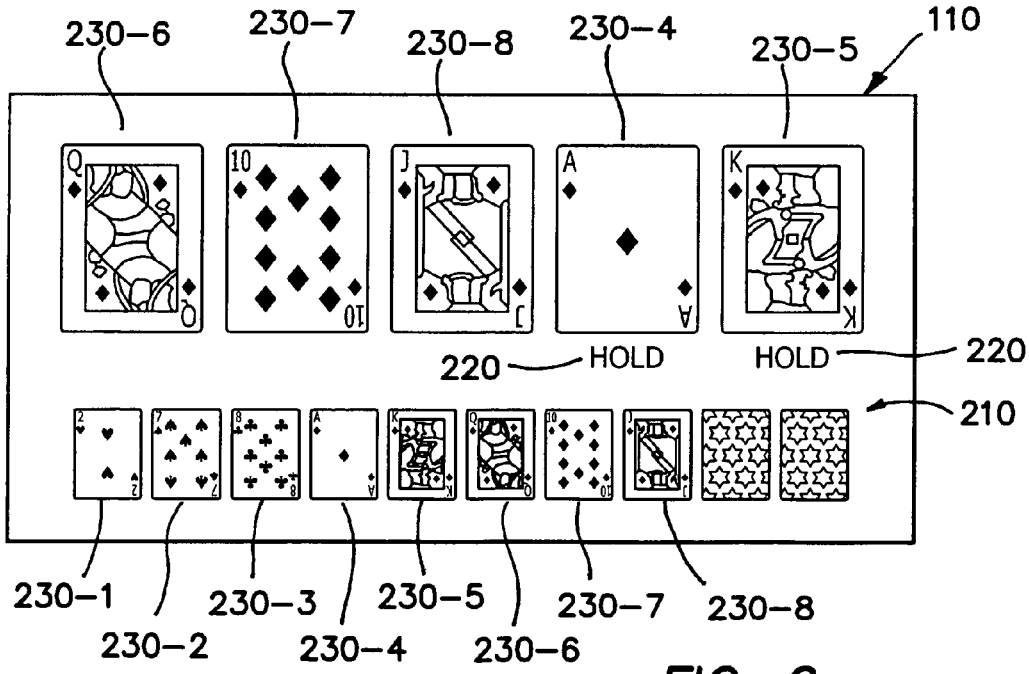
FIG. 6 shows the second example hand once replacement cards have been dealt.

Now referring to FIG. 5, the display screen 110 displays a second initial five card poker hand, for illustrating a second optional bonus scheme, comprising the 2♥ 230-1, 7♠ 230-2, 8♣ 230-3, A♦ 230-4 and K♦ 230-5. The cards 230-1 through 230-5 are also displayed in the bonus hand window 210. Based on basic video poker strategy, a player holds, as indicated by the HOLD icon 220, the A♦ 230-4 and K♦ 230-5. FIG. 6 shows the discards 230-1 through 230-3 replaced with the Q♦ 230-6, 10♦ 230-7 and J♦ 230-8. In this instance, the Royal Flush is formed by five consecutive cards in the bonus hand window 210. Accordingly, the player may receive a bonus award for the bonus hand Royal Flush formed by five consecutively arranged cards in the bonus hand window 210. Additionally, the player wins an award pursuant to pay table 190 for the Royal Flush primary poker hand.

Figure 7:
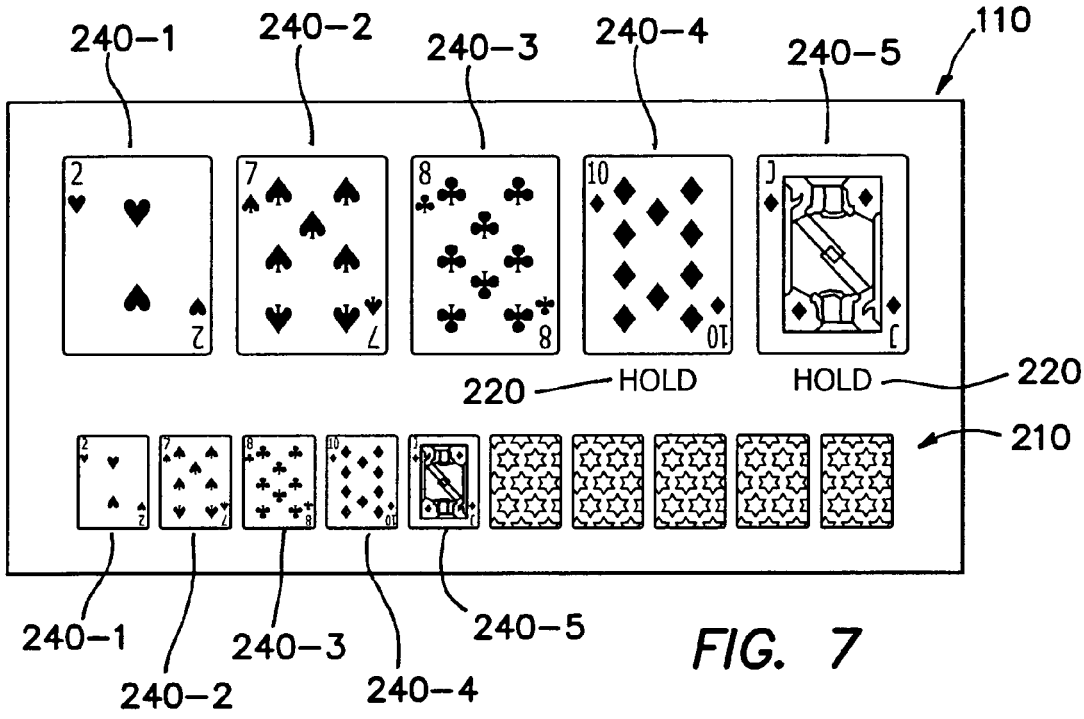
FIG. 7 shows a third example hand on a the display screen incorporating the bonus hand window.
Figure 8:
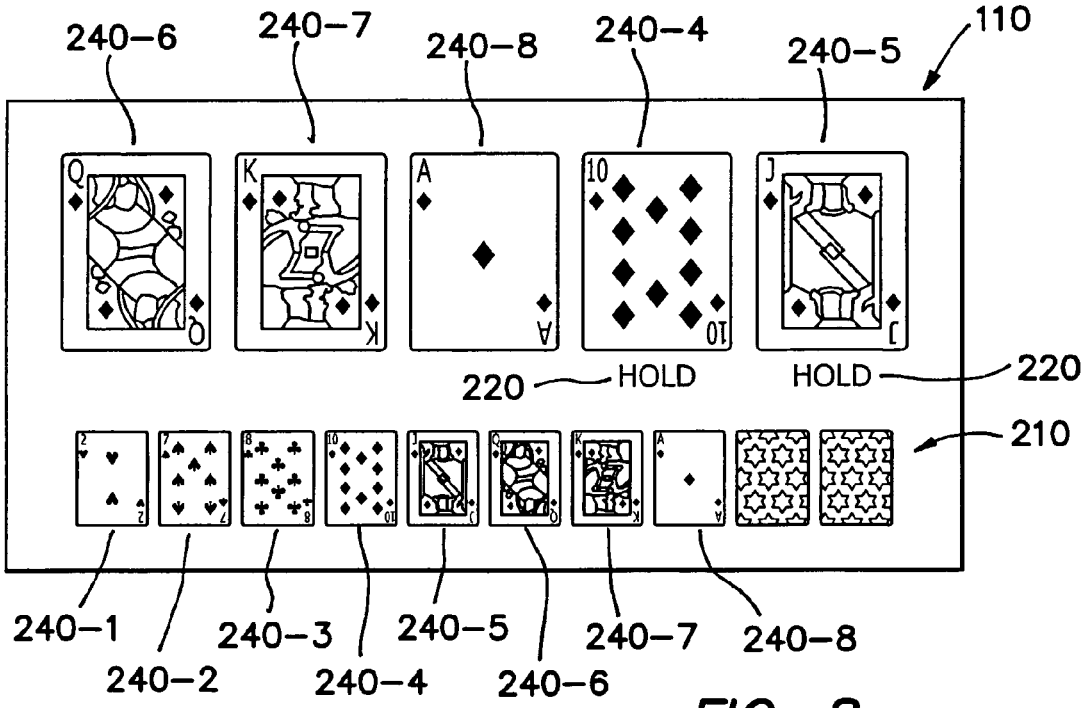
FIG. 8 shows the third example hand once replacement cards have been dealt.

FIG. 7 shows a third initial five card poker hand, for illustrating a third optional bonus scheme, comprising the 2♥ 240-1, 7♠ 240-2, 8♣ 240-3, 10♦ 240-4 and J♦ 240-5. Again, the cards 240-1 through 240-5 are displayed in the bonus hand window 210. The player has elected to hold the 10♦ 240-4 and J♦ 240-5. FIG. 8 shows the discards 240-1 through 240-3 replaced with the Q♦ 240-6, K♦ 240-7 and A♦ 240-8. In this instance, the Royal Flush is formed by five consecutive cards and they are also in sequence (i.e., from low to high) in the bonus hand window 210. Accordingly, the player may receive a bonus award for the bonus hand Royal Flush formed by five consecutive cards arranged in sequence in the bonus hand window 210. Additionally, the player wins an award pursuant to pay table 190 for the Royal Flush primary poker hand. The sequence may also relate to the strength of certain card suits. For example, in some locations the card suits are ranked (e.g., spades, hearts, diamonds and then clubs). Therefore, should the A♠,, A♥, A♦ and A♣ be displayed in sequence from left to right, the player may win an enhanced award. Other suit rankings are possible as well.

Figure 9:
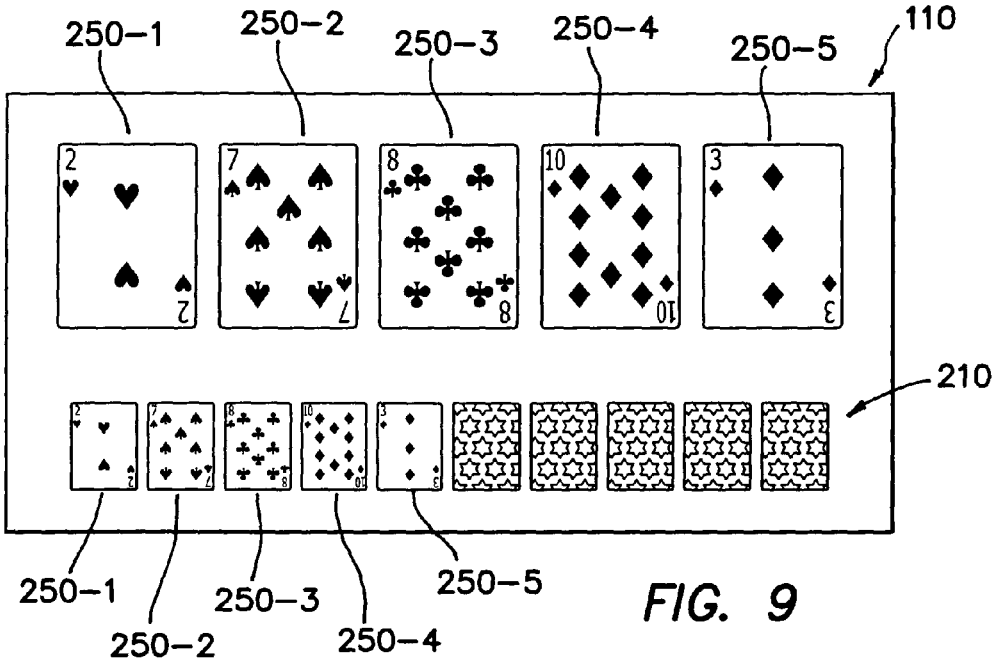
FIG. 9 shows a fourth example hand on a the display screen incorporating the bonus hand window.
Figure 10:
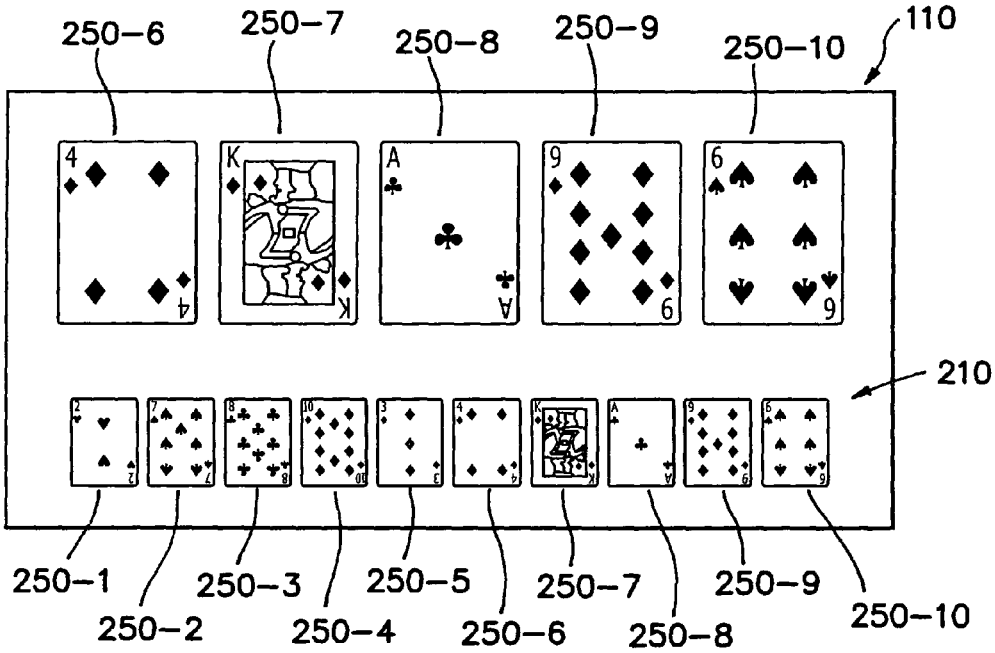
FIG. 10 shows the fourth example hand once replacement cards have been dealt.

FIG. 9 shows a fourth initial five card poker hand comprising the 2♥ 250-1, 7♠ 250-2, 8♣ 250-3, 10♦ 250-4 and 3♦ 250-5. The cards 250-1 through 250-5 are displayed in the bonus hand window 210. As the initial five cards 250-1 through 250-5 are junk cards, the player has decided to discard them all. Accordingly, FIG. 10 shows the discards 250-1 through 250-5 replaced with the 4♦ 250-6, K♦ 250-7, A♣ 250-8, 9♦ 250-9 and 6♠ 250-10. Thus, even though the primary poker hand does not correspond to an award, the bonus hand, as shown in the bonus hand window 210, includes a flush formed by the 10♦ 250-4, 3♦ 250-5, 4♦ 250-6, K♦ 250-7 and 9♦ 250-9. Accordingly, the player may receive a bonus award under the first optional bonus scheme based on the strongest five-card poker hand formed by all cards dealt during the game. Had the 10♦ 250-4, 3♦ 250-5, 4♦ 250-6, K♦ 250-7 and 9♦ 250-9 been consecutively displayed in the bonus hand window 210 and the player had placed a corresponding wager, the player would have also been eligible for the second optional bonus scheme.

In an alternative embodiment, regardless of the number of discards and replacement cards, the bonus hand is always formed of ten cards. That is, the initial five cards plus the next five cards from the top of the simulated deck. The optional bonus schemes remain the same in this embodiment but the bonus hand is always based on the first ten cards from the top of the deck. Displaying the ten cards also allows players see what outcomes would occur depending on different selected hold cards. The cards may also be dealt randomly from the deck rather than from the top. With any of the embodiments, the optional bonus schemes may be offered and wagered on separately or may be offered and wagered on in combination.

Any video poker variation, including, but not limited to, jacks or better, joker poker, double bonus poker, double-double bonus poker and deuces wild, may be enhanced by the embodiments of the present invention. Accordingly, the primary game may be variation of video poker (e.g., double-double bonus poker) and the bonus wager may be a different variation (e.g., deuces wild). Optionally, players may place multiple bonus wagers on multiple video poker variations based on a single primary game. In such an arrangement, multiple hands corresponding to each bonus wager may be displayed simultaneously and separately on the display screen. In addition, the payouts, if any, may be displayed adjacent to the specific hand. In addition, while the embodiments disclosed herein are best-suited for an electronic gaming machine, the game may also be played with a physical deck of cards and a live dealer using a gaming table.

Although the invention has been described in detail with reference to several embodiments, additional variations and modifications exist within the scope and spirit of the invention as described and defined in the following claims.

I claim:

1. A method of playing a poker-based wagering game on an electronic gaming device having a processor, random number generator, one or more player interfaces and a display screen comprising:

accepting a player wager which is registered by said processor;

displaying on said display screen a player with five initial random cards forming an initial poker hand;

via said one or more player interfaces, allowing the player to hold or discard each of the initial cards;

displaying on said display screen random replacement cards for each discard forming a final poker hand; and providing an award based on a rank of a bonus poker hand formed by each of the initial cards, including both held and discarded initial cards, in combination with each of the replacement cards, said award further based on a number of cards forming the bonus poker hand such that unique pay tables relative to six-card, seven-card, eight-card, nine-card and ten-card bonus hands are used to generate the award wherein the bonus poker hand comprises a number of cards equivalent to a number of initial cards plus replacement cards.

2. The method of claim 1 wherein the award is further based on the order the initial cards and the replacement cards are provided.

3. The method of claim 1 wherein the award is further based on a sequence of the cards forming the bonus poker hand.

4. The method of claim 1 wherein the player is provided with five initial cards.

5. The method of claim 1 wherein the initial cards and replacement cards are displayed from left to right in the order provided.

6. The method of claim 1 further comprising allowing the player to place multiple bonus wagers based on different poker variations.

7. The method of claim 6 wherein the different poker variations comprise double bonus poker, double-double bonus poker, deuces wild and jacks or better poker.

8. The method of claim 6 wherein a poker hand corresponding to each wager is displayed simultaneously and separately on a display screen.

9. A method of playing a poker-based wagering game on an electronic gaming device having a processor, random number generator, one or more player interfaces and a display screen comprising:

accepting a player wager which is registered by said processor;

displaying on said display screen a player five initial random cards forming an initial poker hand;

via said one or more player interfaces allowing the player to hold or discard each of the five initial cards;

displaying on said display screen random replacement cards for each discard forming a final poker hand; and resolving the player wager based on a rank of a bonus poker hand formed by the five initial cards, including both held and discarded initial cards, in combination with each of the replacement cards, said award further based on a number of cards forming the bonus poker hand such that unique pay tables relative to six-card, seven-card, eight-card, nine-card and ten-card bonus hands are used to generate the award wherein the bonus poker hand comprises a number of cards equivalent to a number of initial cards plus replacement cards.

10. The method of claim 9 wherein the wager is resolved further based on the order the five initial cards and the replacement cards are dealt.

11. The method of claim 10 wherein the wager is resolved further based on a sequence of the cards forming the bonus poker hand.

12. The method of claim 9 wherein the initial cards and the replacement cards are displayed on the display screen from left to right in the order dealt.

13. The method of claim 9 further comprising allowing the player to place multiple bonus wagers based on different poker variations.

14. The method of claim 13 wherein the different poker variations comprise double bonus poker, double-double bonus poker, deuces wild and jacks or better poker.

15. The method of claim 13 wherein a poker hand corresponding to each wager is displayed simultaneously and separately on a display screen.

16. A method of playing a wagering game facilitated by an electronic gaming device having a processor, random number generator, one or more player interfaces and a display screen comprising:

configuring said processor for displaying on the display screen five initial cards in a primary poker hand location and one or more bonus hand locations;

configuring said one or more player interfaces to allow a player to hold or discard each of the five initial cards;

configuring said processor for removing the discards from the primary hand location;

configuring said processor for displaying the replacement cards in place of each discard in the primary hand location and in the one or more bonus hand locations such that the one or more bonus hand locations display the five initial cards and each of the replacement cards; and configuring said processor for providing a player award based on a rank of a bonus poker hand formed by the cards displayed in the one or more bonus hand locations, said award further based on a number of cards forming the bonus poker hand such that unique pay tables relative to six-card, seven-card, eight-card, nine-card and ten-card bonus hands are used to generate the award wherein the bonus poker hand comprises a number of cards equivalent to a number of initial cards, including both discards and held cards, and replacement cards.

17. The method of claim 16 wherein the award is further based on the order the five initial cards and the replacement cards are displayed in the one or more bonus hand locations.

18. The method of claim 16 wherein the award is further based on a sequence of the cards forming the bonus poker hand.

19. An electronic gaming device comprising:

means for accepting player wagers;

a processor in communication with a random number generator, display and interface means, said processor, random number generator, display and interface means configured to:

a. display one or more initial cards in a primary hand location and a bonus hand location positioned adjacent the primary hand location;

b. permit a player to hold or discard each of the of the one or more cards in the primary hand location;

c. display random replacement cards in place of each discard in the primary hand location and in the one or more bonus hand locations such that the one or more bonus hand locations display the one or more initial cards and each of the replacement cards; and d. provide a player award based on a rank of a bonus poker hand formed by the cards displayed in the one or more bonus hand locations, said award further based on a number of cards forming the bonus poker hand such that unique pay tables relative to six-card, seven-card, eight-card, nine-card and ten-card bonus hands are used to generate the award wherein the bonus poker hand comprises a number of cards equivalent to a number of initial cards, including both discards and held cards, and replacement cards.

20. The gaming device of claim 19 wherein the award is further based on the order the cards are displayed in the one or more bonus hand locations.

21. The gaming device of claim 19 wherein the award is further based on a sequence of the cards forming the bonus poker hand.

22. The gaming device of claim 19 further comprising allowing the player to place multiple bonus wagers related to different poker variations.

23. The gaming device of claim 22 wherein the different poker variations comprise double bonus poker, double-double bonus poker, deuces wild and jacks or better poker.

24. The gaming device of claim 22 wherein a poker hand corresponding to each wager is displayed simultaneously and separately on the display.

* * * * *